United States Patent [19]

duBourg

[11] Patent Number: 4,487,041

[45] Date of Patent: Dec. 11, 1984

[54] METHOD AND APPARATUS FOR DRYING MOIST SKINS

[75] Inventor: Jean-Pierre duBourg, Gex, France

[73] Assignee: Patpan, Inc., Panama City, Panama

[21] Appl. No.: 246,092

[22] Filed: Mar. 20, 1981

[30] Foreign Application Priority Data

Mar. 27, 1980 [CH] Switzerland ..... 2397/80

[51] Int. Cl.[3] ..... C14B 1/26; C14B 1/40

[52] U.S. Cl. ..... 69/1; 69/19.1; 69/33

[58] Field of Search ..... 69/1, 19.1, 19.3, 33, 69/19; 432/121; 34/201, 236, 150

[56] References Cited

U.S. PATENT DOCUMENTS 3,850,013 11/1974 Polvara ..... 69/1

4,100,771 7/1978 Dokoupil ..... 69/33

*Primary Examiner*—Patrick D. Lawson

*Attorney, Agent, or Firm*—Watson, Cole, Grindle & Watson

[57] ABSTRACT

A method and apparatus for proportionally stretching a skin in multiple directions from the center of the skin. The degree of stretching is proportional to the distance of the periphery of the skin from its center. The skin is clamped at its periphery to multiple perforated pivotable plates which stretch the skin upon contact with a cover member. The cover member hermetically seals the skins whereupon a subatmospheric pressure is applied thereto at a temperature below 75° C.

7 Claims, 4 Drawing Figures

FIG. 2
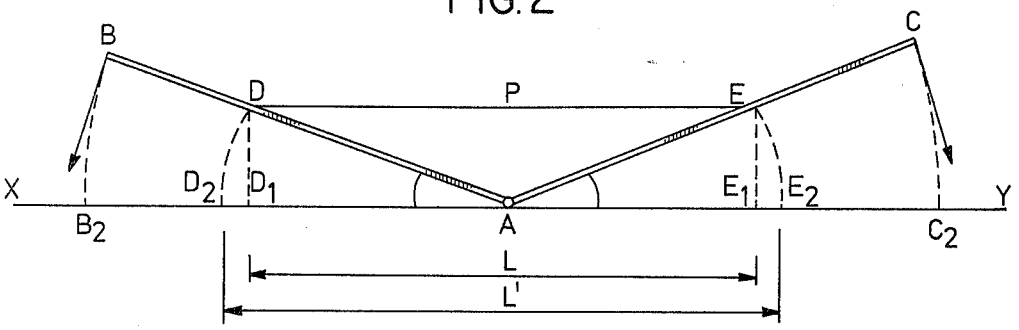
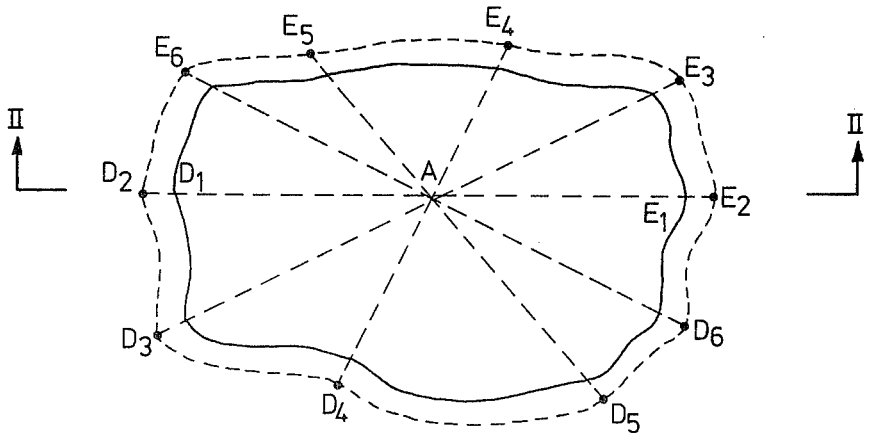
FIG. 1

METHOD AND APPARATUS FOR DRYING MOIST SKINS

BACKGROUND OF THE INVENTION

1. Field of the Invention

This invention relates to a method of drying moist skins, and to apparatus for putting this method into practice.

By the term "skins" there is to be understood both raw or tanned animal skins as well as leathers of all types.

2. Description of the Prior Art

The drying of initially pre-stressed moist skins is known and has been effected over a long period by simply nailing skins on frames or panels of wood by two operators disposed opposite to one another and pulling simultaneously the edge of the skin at two opposed points on its periphery before placing a nail in the said edges adjacent to the pulling points, and this operation is repeated around the periphery of the skin. The skins then dry by natural ventilation or in drying rooms where the nailing frames are placed.

This rudimentary method is slow and laborious, the tensioning of the skin is irregular and the periphery of the skin is damaged by the holes made by the nails.

In order to reduce these disadvantages there have been proposed subsequently, metal perforated frames on which the skins are stretched in all directions manually by menas of wedge clamps provided with a catch at their lower part, the said catch being engaged in one of the holes of the perforated frames, which are placed in the drying rooms utilising hot air.

But the stretching of the skins, remaining independent of the force exerted by the operators, is irregular and the overall operations remain laborious and slow.

In order to equalize the tension exerted on the skins, to render the operation less laborious and improve productivity, an apparatus has been proposed in which the metal perforated frames are divided into two parts which become spaced from one another after the operators have secured the skins, without stretching them. This spacing is effected either by purely mechanical means (cams and guides) over a predetermined distance, or by pneumatic or hydraulic means using a predetermined force. The frames, either individual or forming a continuous surface, then pass into ventilated hot air enclosures where the stretched skins are exposed to infra-red radiation for drying purposes.

These apparatus have the serious disadvantage of only stretching the skin in a single sense and not in all directions as is necessary because of the irregular shape of the skins, and as it has been previously effected, although imperfectly, by the previous manual stretching.

Another disadvantage of these apparatus is that for predetermined control the two halves of each skin are neither spaced by a fixed distance, nor stretched with a fixed force without having regard to the dimension of the skin between the two opposed clamps, nor to the variable dimensions of the different skins, in such a manner that the parts of the skin of small dimension are stretched through the same distance or with the same force as the larger parts, which is clearly illogical and causes a loss of surface following the stretching in a single sense, and distortions which affect the structure and the properties of the skins for their final uses.

Finally, apparatus are known which effect stretching of the skins in multiple directions, the stretching clamps being mounted in slides placed as the spokes of a wheel within the interior of a stretching frame, stretching being effected in accordance with a predetermined force, identical for all the clamps, by pneumatic or hydraulic means. As hitherto known, the stretching frames are placed in a hot air ventilating room.

The disadvantage of stretching in accordance with a fixed force, without regard to the dimension of the skin between the two opposed clamps or to the disparitities in the dimensions of the skins therefore remains.

Another disadvantage of these apparatus is their extreme complexity in order to effect multiple movements on a large number of individual clamps, which gives rise to many risks in operation and an excessively high price which takes them beyond any economic justification, two reasons for which the use of these apparatus has not been developed.

In addition, all the apparatus referred to hereinbefore give rise to other disadvantages with regard to the drying itself. The hot air ventilation drying rooms dry slowly because of the low temperature needed for a good quality of final skins, which necessitates a fairly large number of stretching frames for a given production, with as a consequence, very bulky and costly installations. Moreover, drying by infra-red radiation used to reduce the duration of the drying time and the importance of installations applied to skins at an elevated temperature seriously affects their quality. In addition, the energy efficiency of short wave radiations used is low.

SUMMARY OF THE INVENTION

According to the present invention there is provided a method of drying of a moist skin including the steps of stretching a skin in multiple directions in relation to the center of the skin, the degree of stretching in any given direction being proportional to the dimension of the skin between the corresponding stretching points, placing the thus stretched skin in an enclosure to which a sub-atmospheric pressure is applied and heating the stretched skin at a temperature of less than 75° C.

Further according to the present invention there is provided apparatus for drying a moist skin including an array of perforate sectors pivotal at the center of a plane base, the pivot axes being parallel to the plane of the base but at right angles to a corresponding radial line, spring and a mechanism biasing the sectors away from the base, means for limiting the bias action so that all the sectors assume the same angle to the base under the action of the bias. The perforation of the sectors enables clamps secured to opposed peripheral points of a skin to be attached to the sectors at points from the center of the skin proportional to the distance between corresponding opposed points so that when the bias is overcome and the sectors are pivoted into a given plane the stretching effected is proportional to the above noted distances. A cover capable of resisting internal subatmospheric pressures and having dimensions such that it can fully cover the array of sectors is provided along with a fluid-tight seal surrounding the sectors and serving when the cover is lowered on to the sectors to overcome the spring bias to form a hermetically-sealed enclosure. A heating assembly is provided within the enclosure for heating a skin to a temperature less than 75° C. and a suction source is included for applying a sub-atmospheric pressure to the interior of the enclosure.

BRIEF DESCRIPTION OF THE DRAWINGS

The invention will now be described, by way of example, with reference to the accompanying diagrammatic drawings, in which:

FIGS. 1 and 2 are representations respectively in plan and in section along the line II—II of FIG. 1 of one method of stretching skins according to the invention.

DETAILED DESCRIPTION OF THE PREFERRED EMBODIMENT

According to FIG. 2, a piece of moist skin P is secured by clamps (not shown) each provided with a hook at two opposed points on its periphery D and E on two rigid members AB and AC capable of pivoting at the point A disposed below the central part of the skin P. The pivot axis is horizontal and disposed at right angles in relation to the longitudinal directions of the rigid members considered. These rigid members are inclined to one another at a common angle $\alpha$ in relation to a horizontal plane XY. By applying at B and C forces sufficient to overcome the elasticity of the skin, the members AB and AC are folded down onto the horizontal plane XY to the positions $AB_2$ and $AC_2$ which gives rise to movements of the points D and E to $D_2$ and $E_2$ and stretching of the skin between these two points to a length L', (an extension equal to $D_1 D_2 + E_1 E_2$, in relation to its initial dimension L. As $D_1 D_2$ and $E_1 E_2$ are proportional on the one hand to $1-\cos\alpha$ and on the other hand to AD and AE respectively, the extension, for a given angle $\alpha$, is thus proportional to the distance of the two proposed stretching points D and E and thus to the dimension of the skin between these two points.

If there are arrayed a plurality of rigid members similar to AB and AC disposed radially about the point A, all inclined at the same angle $\alpha$ with respect to the horizontal, and if the members are secured at various opposed points to the periphery of the skin, there will be obtained, by pivoting all these elements in to a horizontal plane, stretching of the skin which will in each instance be proportional to the dimension of the skin between two opposed points $D_2 E_2$, $D_3 E_3$, $D_4 E_4$, $D_5 E_5$ and $D_6 E_6$ (FIG. 1) and in the same proportion - or the same percentage, since the angle $\alpha$ remains the same.

By multiplying the stretching points all around the skin, there is effected a generalized stretching of the skin proportional only in all senses, to its initial dimension, without any factor of distortion or arbitrary fixing, or left to chance. It is not necessary that the skin secured to the rigid members, should after stretching, have an exactly horizontal position.Furthermore, the pivot axes of the rigid members may be disposed at a certain distance from a central point, if the distance is the same for all the rigid members.

By causing a variation in the angle $\alpha$ by a common value for all the rigid members, such as AB, AC, there will be obtained at will different extension percentages, each time, however, proportional to $1-\cos\alpha$.

These extension percentages given by a simple trigonometrical calculation, are, for example:

About 3% for $\alpha=15°$.

About 6% for $\alpha=20°$.

About 10% for $\alpha=25°$.

Figure 4:
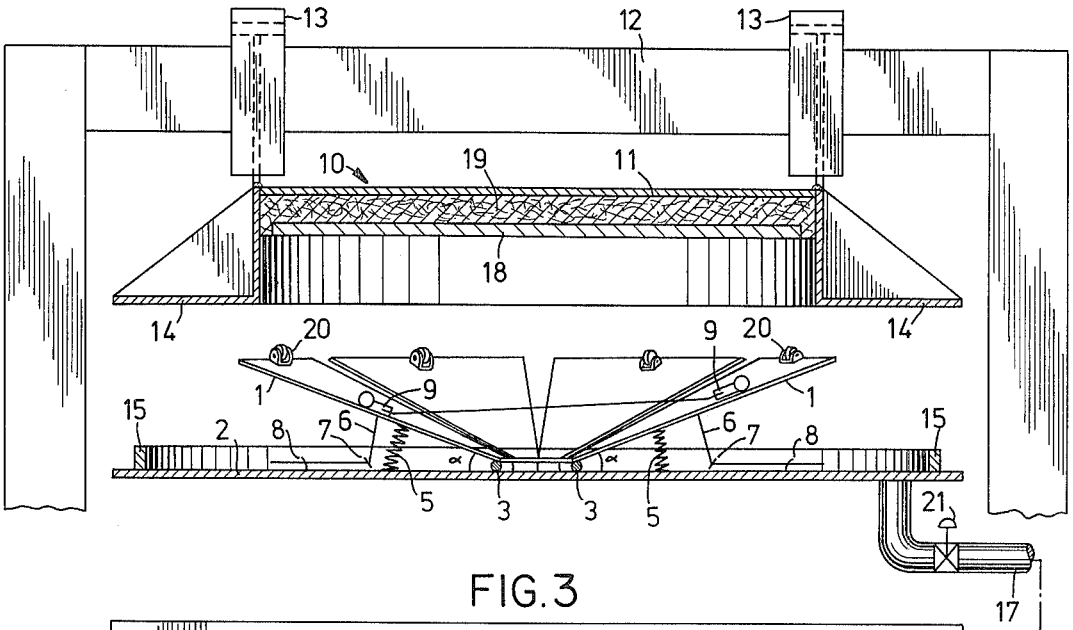
FIGS. 3 and 4 show respectively in plan and in section along the line IV—IV of FIG. 3, an embodiment of apparatus for putting into practice the method according to FIGS. 1 and 2.
Figure 3:
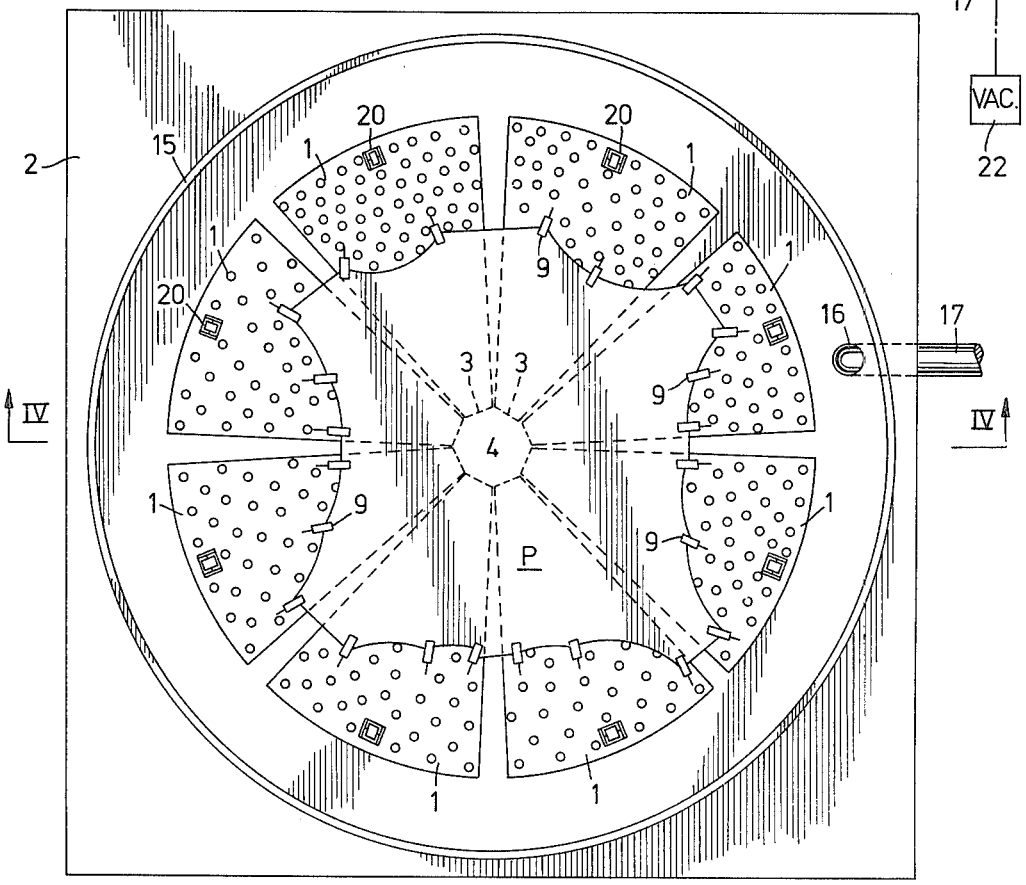

An embodiment for putting into practice the method in accordance with the invention includes a stretching installation enabling the extension of the skins in the manner described, and is illustrated in FIGS. 3 and 4.

The members on which opposed points of the periphery of the skin to be stretched are secured are generally triangular sectors in the form of rigid, perforate sector plates 1 pivoting on a rigid, fixed base 2 at hinges 3 disposed around and close to the center 4 of the base 2.

Springs 5, with a force somewhat higher than the force necessary to raise the perforate sector plates 1, are secured on the base 2 and push the perforate sectors 1 upwardly to inclined positions.

A web 6 of flexible but inextensible material is secured at the axis of symmetry of each sector plate 1 and at the same distance for each of them from the respective hinge 3. This strip 6 passes below a guide 7 mounted on the base 2 at the same distance for all the sector plates 1 from the respective hinge 3. Each web 6 is provided with a series of holes which enables engagement of a catch 8 secured to the base 2 in order thus to limit at will the upward movement of the perforate sector plates under the action of the respective springs 5. By engaging the various holes of the web 6 to the catch 8 it is thus possible to vary at will and regulate with precision the angle $\alpha$ of inclination of the sector 1 with respect to the base 2. Each hole advantageously carries a scale marking indicating the percentage of extension of the skins corresponding to the angle predetermined by that hole.

A skin P is engaged at different points of its periphery on the sectors 1 by clamps 9 provided at there lower part with a catch which enables them to be hooked into the perforations of the sectors 1. Various forms of these clamps exist in commerce.

A cover 10 (FIG. 4) made in the form of a shell 11 reinforced in order to resist the crushing effect caused by vacuum action, has dimensions such that it covers all the sectors 1, and is mounted on a gantry 12 through the intermediary of pneumatic or hydraulic jacks 13 which enable raising of the cover 10 or lowering it down until a peripheral plane surface 14 rigid with the shell 11, comes into contact with a fluid-tight seal 15 secured to the peripheral part to the base 2, surrounding the whole of the sectors 1 so that the base 2, the cover 10 and the seal 15 form a hermetically-sealed chamber connected by an orifice 16 and a pipe 17 to a vacuum source 22.

Within the shell 11, there are provided panels 18 supplied with electrically, which are emitters of infrared radiation with a wavelength less than 7 micron. These panels are insulated from the upper part of the shell 11 by a layer of insulating material 19.

When the peripheral plane surface 14 of the cover 10 approaches the seal 15 under the action of the jacks 13 it is applied on the outer end portions of the sector plates 1 and forces them to be lowered simultaneously down to the horizontal when the surface 14 comes into contact with the seal 15, thus causing extension of the skin P simultaneously in all defined directions by the pairs of opposed clamps 9. The outer ends of the sector plates 1 are provided with small rollers 20 which roll on the peripheral surface 14 of the cover 10 during its descent or its subsequent ascent.

When the cover 10 is applied to the seal 15, an electrical contact (not shown) automatically causes the opening of the valve 21 disposed in the piping 17 thus placing the hermetically-sealed chamber in which the skin P lies in communication with the vacuum source 22.

The infra-red radiation of high wavelength and the action of vacuum taken together thus cause the rapid evaporation at low temperature of the moisture contained in the skin P stretched during the whole duration of the drying, and this duration is controlled by an automatic time switch.

When the predetermined drying time has elapsed, the timing switch effects the closure of the vacuum valve 21, raises the cover 10 by the jacks 13 which enables the springs 5 to return the sector plates to their initial inclined positions and permits the release of the clamps 9 and thus the skin P from the frame.

The gantry 12 is then displaced horizontally in order to move away from the working plane, and the cover 10 is then placed above a second stretching installation identical to that described hereinbefore, while the operators remove the skin P, now dry, and replace it with another moist skin.

It will be apparent that the number of perforate sector plates 1, the shape and the dimensions of the perforate sector plates, the cover 10 and of the stretching installation can be varied as a function of the shapes and the dimensions of the skins to be dried, as well as the number of stretching installations/drying installations and corresponding covers in order to vary as a function of the production to be effected.

It is possible to replace the infra-red radiation emitting panels 18 by a mechanism for generating an electromagnetic, high-frequency, field so that the stretched skin will be heated to a temperature between 20 and 75° C., preferably lower than 50° C. in order to maintain the quality of the skin.

Obviously . . .

We claim:

1. An apparatus for stretching and drying a moist skin having a center comprising:

a planar base member having a center;

a plurality of sector plates each having a plurality of perforations formed therein and pivotally connected to said planar base member about a pivot axis disposed proximate to said center of said planar base member and parallel or coincident with said planar base member;

spring means operatively associated with said plurality of sector plates for biasing said plurality of sector plates away from said planar base member;

limiting means for limiting said spring means such that each of said plurality of sector plates forms a mutually equal angle with respect to said planar base member;

a plurality of clamps operatively associated with said plurality of perforations formed in each of said plurality of sector plates for securing said skin at substantially geometrically opposed peripheral stretching points of said skin and for attaching said skin to each of said plurality of sector plates at points from said center of said skin proportional to the distance between said opposed peripheral stretching points, such that pivoting of said plurality of sector plates against said spring means and toward said planar base member effects said stretching proportional to the distance between said opposed peripheral stretching points, and such that said center of said skin is disposed adjacent said center of said planar base member upon completion of said pivoting;

a cover member having means for resisting subatmospheric pressures and for completely covering said plurality of sector plates;

a fluid tight seal surrounding said plurality of sector plates for forming a hermatically sealed enclosure around said plurality of sector plates upon contact with said cover member;

means disposed within said enclosure for heating said skin to a temperature below 75° C.; and means for generating a sub-atmospheric pressure within the interior of said enclosure.

2. An apparatus according to claim 1 wherein said limiting means further comprises adjusting means for controlling said stretching of said skin.

3. An apparatus according to claim 1 or 2 further comprising:

a gantry disposed adjacent said planar base member for supporting said cover member and for moving said cover member laterally about said cover member; and means for moving said cover member towards and away from said plurality of sector plates and comprising at least one jack mounted on said gantry.

4. An apparatus according to claim 1 or 2 wherein said fluid tight seal disposed on said planar base member for limiting pivotal movement of said plurality of sector plates towards said planar base member.

5. An apparatus according to claim 1 or 2 wherein said fluid tight seal is disposed on a peripheral portion of said cover member for limiting pivotal movement of said plurality of sector plates towards said planar base member.

6. An apparatus according to claim 1 or 2 wherein said means for heating further comprises an electrical infrared emitter of radiation having a wavelength less than seven microns.

7. An apparatus according to claim 1 or 2 wherein said means for heating further comprises a high frequency electromagnetic wave generator having a wavelength less than seven microns.

* * * * *